United States Patent [19]

Horner

[11] Patent Number: 4,850,705

[45] Date of Patent: Jul. 25, 1989

[54] MOTIONLESS MIXERS AND BAFFLES

[76] Inventor: Terry A. Horner, 143 S. Main, Allenstown, N.J. 08514

[21] Appl. No.: 247,708

[22] Filed: Sep. 22, 1988

Related U.S. Application Data

[63] Continuation-in-part of Ser. No. 121,935, Nov. 18, 1987.

[51] Int. Cl.[4] ..... B01F 5/06

[52] U.S. Cl. ..... 366/339; 366/338

[58] Field of Search ..... 366/336–340, 366/176, 341; 138/38, 40, 42; 137/896; 48/180.1, 180.6

[56] References Cited

U.S. PATENT DOCUMENTS

| | | | |
|---|---|---|---|
| 3,620,506 | 11/1971 | So . | |
| 3,643,927 | 2/1972 | Crouch . | |
| 3,652,061 | 3/1972 | Chisholm . | |
| 3,664,638 | 5/1972 | Grout et al. . | |
| 3,704,006 | 11/1972 | Grout et al. . | |
| 3,733,057 | 5/1973 | Kahoun . | |
| 3,794,300 | 2/1974 | Harder . | |
| 3,827,888 | 8/1974 | Terwilliger et al. . | |
| 3,893,654 | 7/1975 | Miura et al. . | |
| 3,923,288 | 12/1975 | King . | |
| 4,034,965 | 7/1977 | King . | |
| 4,408,893 | 10/1983 | Rice | 366/339 |
| 4,522,504 | 6/1985 | Greverath | 366/339 |
| 4,538,920 | 9/1985 | Drake | 366/339 |

FOREIGN PATENT DOCUMENTS

| | | | |
|---|---|---|---|
| 8301395 | 4/1983 | PCT Int'l Appl. | 366/338 |

*Primary Examiner*—Timothy F. Simone

*Attorney, Agent, or Firm*—Davis, Bujold & Streck

[57] ABSTRACT

The invention relates to motionless mixers and baffles thereof and includes a baffle having a pair of substantially symmetric opposing major surfaces generally helically twisted along a central longitudinal axis of the baffle and a first pair of substantially planar surfaces connecting the pair of major surfaces at one end of the baffle, one of the first pair of planar surface extending both substantially transversely and substantially parallel to the central longitudinal axis. The intersection of the first planar surface and one of the major surfaces forms an edge at the one end of the baffle. Such geometry enables a plurality of the baffles to be formed as a single insert unit by conventional injection molding techniques using only a pair of mold halves. The major surfaces are concave in cross-section normal to the longitudinal axis to form with a housing a pair of passages of generally ovoid (or elliptical) cross-section.

14 Claims, 2 Drawing Sheets

MOTIONLESS MIXERS AND BAFFLES

This is a continuation-in-part of Ser. No. 121935 filed Nov. 18, 1987.

FIELD OF THE INVENTION

The present invention relates to in-line motionless mixing devices for intermixing a plurality of fluids generally referred to as motionless (static) mixers, and, in particular, to the types of such devices employing successive and alternating right- and left-hand helically twisted elements or baffles.

BACKGROUND OF THE INVENTION

Motionless mixers are static mixing devices generally used to intermix two viscous fluids. For example, one may wish to mix a thermoset, which consist of a resin and hardner, e.g. epoxy. This can be done by simultaneously passing both the hardener and resin, in their liquid forms, into a conduit of a motionless mixer containing a multiplicity of baffles. As the fluids travel down through the bore of the conduit they are intermixed in stages corresponding to each baffle of the mixer.

In the past, motionless mixers have employed multiple metallic baffle elements. These baffles were easily made but complicated to assemble in series for use in a static mixer.

Today, conventional motionless mixers are more typically manufactured from plastic by injecting molding, thereby considerably reducing production costs when made on a large scale basis. Representative examples of such motionless mixers are disclosed in U.S. Pat. Nos. 3,286,992 and 3,953,002 and 3,635,444. The plastic mixers are generally comprised of alternately right- and left-handed helically-curved baffles which are either individually disposed within a bore or are adjacently combined during manufacture to form a single unit insert which is disposed within a bore.

The leading edges employed on these plastic baffles vary in design. In one known design, the two major opposing curved surfaces defining the baffle terminate in and are joined by a planar surface extending from, perpendicular to and lying in a plane normal to the central longitudinal axis of each baffle. A problem encountered in using plastic baffles of this type is the decreased efficiency of the mixing process. Viscous materials such as thermoplastics, resins and various other polymers tend to accumulate and build up on the flat surfaces as they pass over the baffles, thus decreasing the efficiency of the mixing process and oftentimes completely blocking the mixer and stopping fluid flow. The flat leading surfaces also cause a substantial reduction in flow cross-section at the intersection of baffle elements, for example at the intersection of elements of 0.5 inches diameter with a 0.125 inch baffle thickness the available flow area is only 40% of the overall cross-sectional area. This reduction in flow cross-section results in substantial fluid pressure drop.

Each of the baffles of another known arrangement include a knife-like edge at one end (the upstream end) formed by tapering the two curved major opposing surfaces of the baffle towards one another. Motionless mixers of this type, present problems in manufacture. Injection molding a baffle having a knife-like edge formed by tapering a pair of major opposing curved surfaces of the baffle towards one another would be both extremely difficult and costly. This is because more than two mold pieces would be required in order to avoid undercuts. This makes the baffle substantially more costly and difficult to produce.

Generally, if not without exception, the baffles forming motionless mixers in the prior art have had a cross-section which is rectangular so that the passages defined by the baffles within its encompassing tube are substantially semi-circular (i.e. a section defined by a portion of a circle subtending an angle approaching 180°, the ends of which are joined by a straight line). As the fluids spiral through these passages the fluid, due to the helical flow pattern, rotates about the center of each passage (i.e. inverts). Optimum performance is achieved only if the fluids rotate 180°. In the past the flat sheet used to make elements, which yield two opposing semicircular or "half moon" cross sections. With this profile the length/diameter (L/D) of the element must be between 1.0 and 1.5 for optimum performance. This L/D ratio produces 180° rotation of the fluid.

The semicircular subchannels resulting from the use of flat elements with rectangular cross sections is acceptable with L/D of greater than 1. However when the L/D ratio is reduced to 0.8:1 or 0.7:1 the amount of rotation decreases. This is particularly true in the corners where the baffles meet the wall where the velocity gradients are near zero. The fluid near the corners is simply dragged along the edge of the element and never mixes with the fluids in the center.

Accordingly, it is an object of the present invention to provide an improved static mixing device for intermixing a plurality of fluids that has a shorter length than previously possible.

More specifically, it is an object to provide a static mixing device of relatively economic construction and improved intermixing efficiency.

SUMMARY OF THE INVENTION

According to the invention, there is provided a static mixer baffle member, said baffle member being helically twisted symmetrically about a longitudinal axis and being defined by opposed major surfaces, which in a cross-section of the baffle normal to the axis are concave, extending along said axis from a first end to a second end of said baffle, said concavity of said major surfaces defining, when said baffle is installed in a tubular housing, with said housing, a pair of generally ovoid or elliptical passages devoid of sharp corners one on either side of the baffle.

Preferably the major surfaces are connected to said first end by two pairs of planar surfaces, each pair being disposed normal to one another, with one of each pair extending substantially transversely of said axis and lying in plane substantially parallel to said axis, each said pair being disposed in symmetrically opposed relationship extending outwardly from said axis in substantially opposite directions.

A further aspect of the invention involves a motionless mixer comprising a plurality of serially arranged oppositely handed baffle members of the invention forming a static mixer element and that element in combination with a tubular housing to define the two substantially elliptical passages.

BRIEF DESCRIPTION OF THE DRAWINGS

The invention will now be described, by way of example, with reference to the accompanying drawings, in which.

DESCRIPTION OF THE PREFERRED EMBODIMENT

Figure 1:
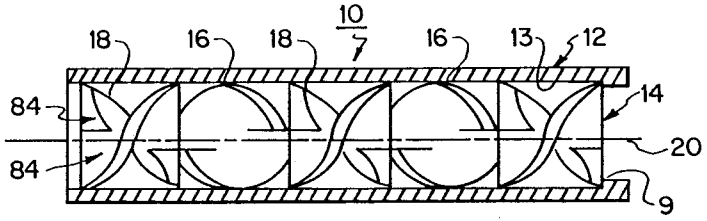
FIG. 1 is a partially sectioned side elevation of a motionless mixer embodying principles of the present invention.

Referring to FIG. 1 a static mixer 10 comprises a tubular housing 12 defining a cylindrical bore 13 through which fluid may flow. A one piece (integrally formed) motionless mixer element 14 is disposed in the bore 13 and is preferably injection molded from a thermoplastic material (e.g. polypropylene). The insert 14 is formed by a first subset of right-handed generally helically curved (twisted) baffles 16 which alternate with a second subset of left-hand generally helically curved (twisted) baffles 18 along a central longitudinal axis 20 of the insert 14 and the bore 13. The insert 14 is a snug fit within the bore 13 and is located by abutment with an annular lip 9 in the tubular housing 12.

Figure 4:
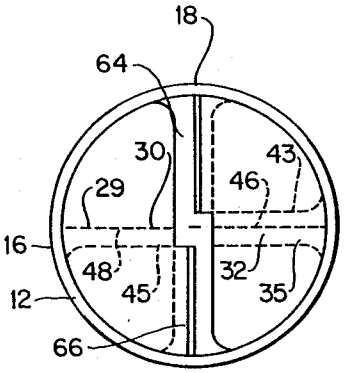
FIG. 4 is an end elevation of the mixer shown in FIG. 1.
Figure 2:
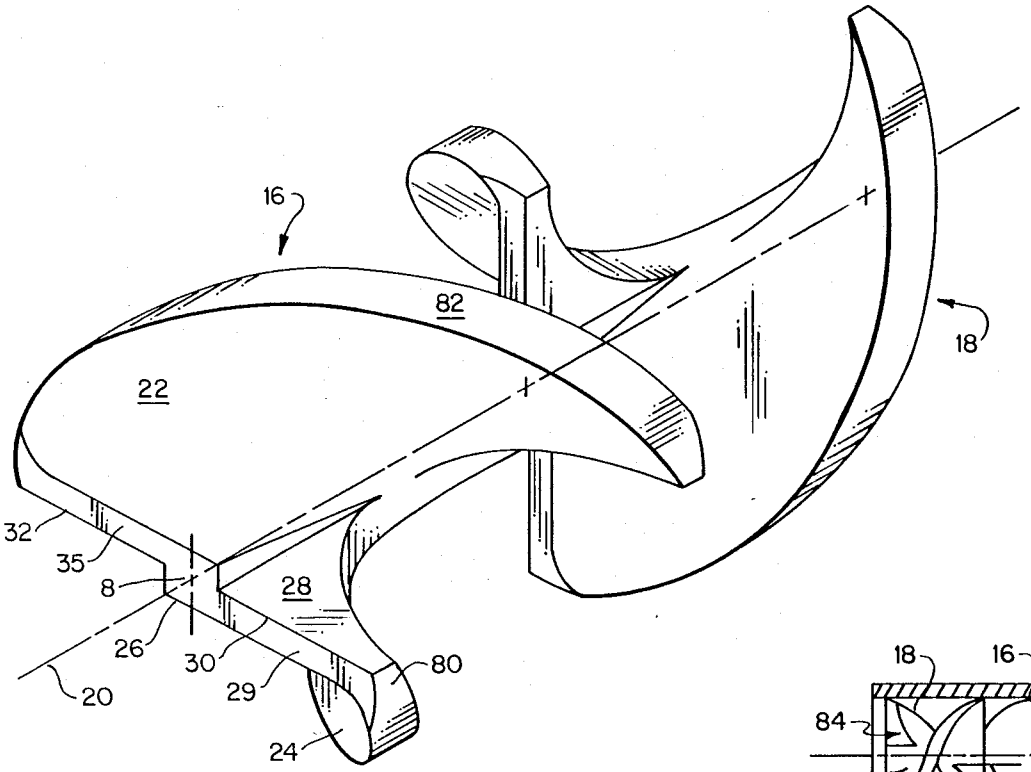
FIG. 2 is an isometric perspective view of a portion of a mixer element of the present invention.
Figure 3:
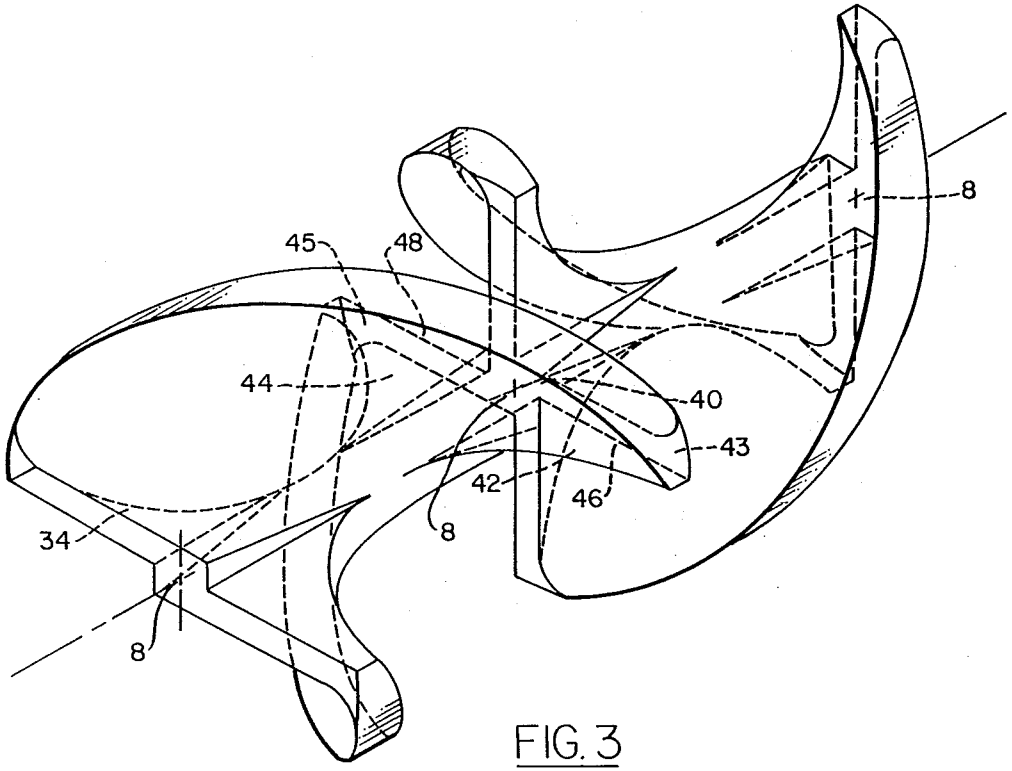
FIG. 3 is a view similar to FIG. 3 but with lines in phantom illustrating features hidden in FIG. 3.

The right-hand curved baffles 16 and left-hand curved baffles 18 of the insert 14 ar serially connected directly to one another by a continuous core 8 (see FIGS. 2, 3 and 4). The central longitudinal axis of each baffle 16 and 18 is coaxial with the central longitudinal axis 20 of the insert.

A typical right hand baffle 16 and the next adjacent (also typical) left-hand baffle 18 are shown in FIGS. 2 and 3. Referring first to the right hand-curved baffle 16, there are a pair of substantially symmetric opposing major surfaces 22 and 24 each generally concave in a plane normal to the axis 20 and helically curved right-handedly along the central longitudinal axis 20 through an angle of approximately 180°. Only a portion of the major surface 24 is visible in FIGS. 2 and 3. A first pair of substantially planar surfaces 28, 29 disposed normal to one another connect the pair of major surfaces 22 and 24 on the near end 26 of the baffle 16. The intersection of the planar surface 29 with the major surface 24 forms a first edge 30 at the near end 26 of the baffle. A second edge 32 is provided at the near end 26 by the intersection of the major curved surface 22 with a surface 35 of a second pair of substantially planar surface 34, 35 also disposed normal to one another. Each of the pairs substantially planar surfaces 28, 29 and 34, 35 connect the major surfaces 22 and 24 at the near end 26 of the baffle 16. Each of the planar surfaces 28 and 34 extends both substantially normal to and lies in a plane substantially parallel to the central longitudinal axis. The surfaces 28 and 34 extend on opposite sides of axis 20, are parallel and tangential to a central core 8 which extend along said axis 20 and is common to and joins together all baffles 16 and 18. Hence, each of the first and second planar surfaces 28 and 34 and each of their edges 30 and 32 is radially displaced from the central longitudinal axis 20 on opposing sides of the central longitudinal axis 20. The surfaces 28 and 34 both face plane 36 through which passes the axis 20. At the opposite end 40 of the baffle 16 the pair of opposing major curved surfaces 22 and 24 are connected by similar pairs of substantially planar surfaces 42, 43 and 44, 45 respectively similar to but oppositely oriented to surfaces 28, 29 and 34, 35 to define edges 46 and 48 oppositely oriented to edges 30 and 32. Planar surfaces 42 and 44 extend both substantially normal to axis 20 and lie in a plane substantially parallel to the axis 20 and are radially displaced from the axis 20 on opposing sides thereof.

Each end 26 and 40 of each of the depicted right-hand curved baffle 16 adjoins an end of a left-hand curved baffle 18. One such baffle 18 is depicted in FIGS. 2 and 3 adjoining end 40 of the right-hand baffle 16. The left-hand baffle 18 has a pair of opposing major surfaces, only a portion of the latter being visible in the view of FIGS. 2 and 3, helically curved left-handedly along the central axis 20 through an angle of approximately 180°. The baffle 18 is essentially the mirror image of baffle 16 when the image reversal is along the axis 20. The baffles are connected by central core 8 and are disposed at an angle to each other, about axis 20, of 90°.

FIG. 4 depicts diagrammatically the leading edges 64 and 66 of an element 18. Depicted in phantom are the adjoining leading edges 30 and 32 of the following right-hand element 16.

Referring again to FIGS. 2 and 3 the baffle 16 includes a pair of circumferential opposing minor surfaces 80 and 82, generally right-hand helically curved along the central axis 20, which are formed to sit flush against an inner wall of the housing 14 forming the cylindrical bore 13. The left-hand baffle 18 includes a similarly oppositely helically curved pair of minor opposing curved surfaces.

In operation, a pair of fluids are introduced into the device 10 onto the opposing major curved surfaces of the lead baffle. This is indicated diagrammatically in FIG. 1 assuming the furthest left left-hand curved baffle 18 is the lead baffle of the insert 14. The pair of fluids are indicated by arrows 84. The alternating helical motion imparted to the fluids with repeated divisions and recombinations of different portions and velocities thereof by the subsequent baffles creates enhanced intermixing. The fluid path within the element is divided between two symmetrical semicircular passageways. Near the end of the element, the passageways alter into assymmetric passageways, having been shifted around the center core in a cartwheel fashion. FIG. 4, illustrates the cartwheel geometry, such that the pair of leading edges of each of the right-hand baffles 16 and left-hand baffles 18 are offset with the pair of trailing edges of the adjacent left-hand baffle 18 or right-hand baffle 16, respectively.

In addition, the narrow edges of the leading or leading and trailing edges of the baffles 16 and 18 increases the cross-sectional area available for flow at the junction of adjacent baffles and creates velocity gradients that increase the fluid area available for splitting the flow. These edges also eliminate the tendency of fluids to accumulate on the edges of the baffles 16 and 18, which would decrease mixing efficiency and possibly completely block fluid flow through the mixer 10. In addition offsetting the edges enable the mixer insert 14 to be injection molded using only a pair of mold halves. This simplifies considerably the injection molding of the insert and minimizes its cost.

Figure 5:
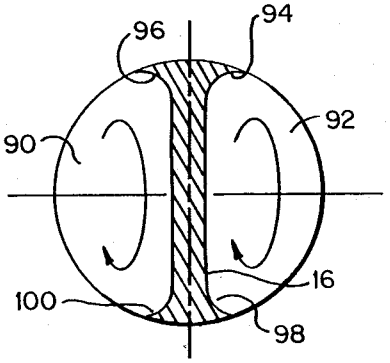
FIG. 5 is a diagrammatic typical cross-section of a baffle member of the invention illustrating the oval cross section of the passages formed thereby.

The cross-section of the baffles 16, 18 is shaped to form, with tubular housing 12, a pair of generally ovoid (substantially or generally elliptical) cross-section passages 90, 92 (FIG. 5). This is achieved by adding concave fillets 94, 96, 98, 100 to the otherwise generally rectangular cross-sectional of the baffles. By doing this the sharp corners where previously little or no mixing occurred are eliminated and the same mixing efficiency can be maintained with a length/diameter (L/D) of between 0.8:1 and 0.7:1 (even as low as 0.5:1 might be usable) as was previously achieved with L/D ratios exceeding 1. The modified baffle cross-section provides major surfaces which are generally concave in cross-section normal to the axis 20.

Although the invention has been described with respect to a preferred embodiment mixer incorporating a one-piece plastic molded insert, individual baffles of the described geometry can be positioned within a passageway to form a mixer enjoying at least some of the advantages of the disclosed preferred embodiment. Moreover, although the baffles 16 and 18 of the preferred embodiment insert are immediately adjoining one another, spacers could be provided between the baffles along the central longitudinal axis 20 of the insert 14 to coaxially separate the adjoining trailing edges and leading edges of adjoining baffles pairs. Similarly, although narrow edges are provided at the leading and trailing edges of each of the baffles of the preferred embodiment, some advantages of the subject invention can be enjoyed by employing edges on only one of the leading and trailing sides of each baffle or on less than all the baffles of an insert or in a static mixer.

From the foregoing description, it can be seen that the present invention provides an easily manufactured and superior performing static mixer. It will be recognized that although certain modifications have been suggested, other changes could be made to the above-described invention without departing from the broad invention concepts thereof. It is understood, therefore, that the invention is not limited to the particular embodiment(s) disclosed, but is intended to cover any modifications which are within the scope and spirit of the invention as defined by the appended claims.

As used herein ovoid or elliptical shall be construed to include a segment of a circle (the area bounded by a chord and an arc of that circle) in which the sharp corners are filled in to form smoothly concave surfaces smoothly joining the arc and chord (including the shape illustrated in FIG. 5 and a variant in which the chord is modified to have a continuous curve to form a continuously concave surface of the baffle.

I claim:

1. A motionless mixer baffle member, said baffle member being helically twisted symmetrically about a longitudinal axis and being defined by opposed major surfaces, which in a cross-section of the baffle normal to the axis are concave, extending along said axis from a first end to a second end of said baffle, said concavity of said major surfaces defining, when said baffle is installed in a tubular housing, with said housing, a pair of generally ovoid passages devoid of sharp corners one on either side of the baffle.

2. A baffle member according to claim 1 wherein said major surfaces are connected to said first end by two pairs of planar surfaces, each pair being disposed normal to one another, with one of each pair extending substantially transversely of said axis and lying in plane substantially parallel to said axis, each said pair being disposed in symmetrically opposed relationship extending outwardly from said axis in substantially opposite directions.

3. A baffle member according to claim 2 wherein said major surfaces are connected at said second end by two pairs of planar surfaces in like manner to the said connection at said first end.

4. A baffle member according to claim 2 wherein said member defines a central core extending symmetrically about and along said axis with said planar surfaces which lie in a plane substantially parallel to said axis extending tangentially of said core, these surfaces each facing a plane passing through said axis and parallel to said planes parallel to said axis.

5. A baffle member according to claim 4 wherein the helical curve subtends an angle of approximately 180°.

6. A motionless mixer element comprising a plurality of members according to claim 2 serially arranged along said axis and alternately of oppositely handed helical twist with adjacent members being oriented approximately 90° apart relative to one another about said axis.

7. A motionless mixer element comprising a plurality of members according to claim 3 serially arranged along said axis and alternatively of oppositely handed helical twist with adjacent member being oriented approximately 90° apart relative to one another about said axis.

8. A motionless mixer element comprising a plurality of members according to claim 4 serially arranged along said axis and alternately of oppositely handed helical twist with adjacent members being oriented approximately 90° apart relative to one another about said axis.

9. A motionless mixer element comprising a plurality of members according to claim 5 serially arranged along said axis and alternately of oppositely handed helical twist with adjacent members being oriented approximately 90° apart relative to one another about said axis.

10. A motionless mixer comprising an element according to claim 6 and a cylindrical tube having an inner surface defining a cylindrical bore, each member of said element being in intimate contact wth said inner surface from its first end to its second end to define two separate substantially equally sized helically curved passages of substantially ovoid cross-section.

11. A motionless mixer comprising an element according to claim 7 and a cylindrical tube having an inner surface defining a cylindrical bore, each member of said element being in intimate contact with said inner surface from its first end to its second end to define two separate substantially equally sized helically curved passages of substantially ovoid cross-section.

12. A motionless mixer comprising an element according to claim 8 and a cylindrical tube having an inner surface defining a cylindrical bore, each member of said element being in intimate contact with said inner surface from its first end to its second end to define two separate substantially equally sized helically curved passages of substantially ovoid cross-section.

13. A motionless mixer comprising an element according to claim 9 and a cylindrical tube having an inner surface defining a cylindrical bore, each member of said element being in intimate contact with said inner surface from its first end to its second end to define two separate substantially equally sized helically curved passages of substantially ovoid cross-section.

14. A mixer element according to claim 6 wherein the plurality of members are integral.

* * * * *